US005839922A

United States Patent [19]

Orlando et al.

[11] Patent Number: 5,839,922

[45] Date of Patent: Nov. 24, 1998

[54] 110 WIRING BLOCK INTERLOCK AND INTERLOCKED BLOCKS UTILIZING SUCH

[75] Inventors: Stephen A. Orlando, Longboat Key, Fla.; Walter R. Schwer, Westerly, R.I.

[73] Assignee: Ortronics, Inc., Pawcatuck, Conn.

[21] Appl. No.: 822,517

[22] Filed: Mar. 24, 1997

[51] Int. Cl.[6] ..... H01R 9/22

[52] U.S. Cl. ..... 439/717

[58] Field of Search ..... 439/717, 540.1, 439/532

[56] References Cited

U.S. PATENT DOCUMENTS 3,611,264 10/1971 Ellis .

4,591,228 5/1986 Vasseur ..... 439/717

4,954,798 9/1990 Kasahara et al. ..... 439/717

5,295,870 3/1994 Rei et al. ..... 439/717

*Primary Examiner*—Gary Paumen

*Attorney, Agent, or Firm*—Pepe & Hazard LLP

[57] ABSTRACT

110-type wiring blocks are modularized with means for connecting a plurality of them to enable a manufacturer to produce a single size (e.g., 100 connector terminals) and yet meet all needs. Several 110 wiring block modules are locked together with U-shaped locking devices to provide a secure interlock that retains structural stability during wiring with IDC connectors and over long periods of use.

13 Claims, 4 Drawing Sheets

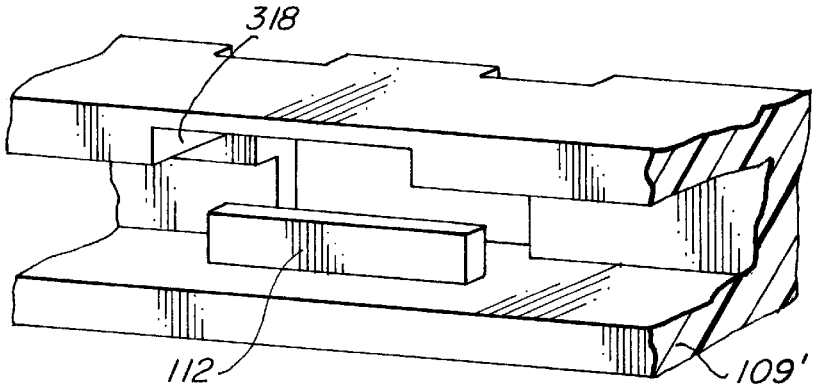
FIG. 9
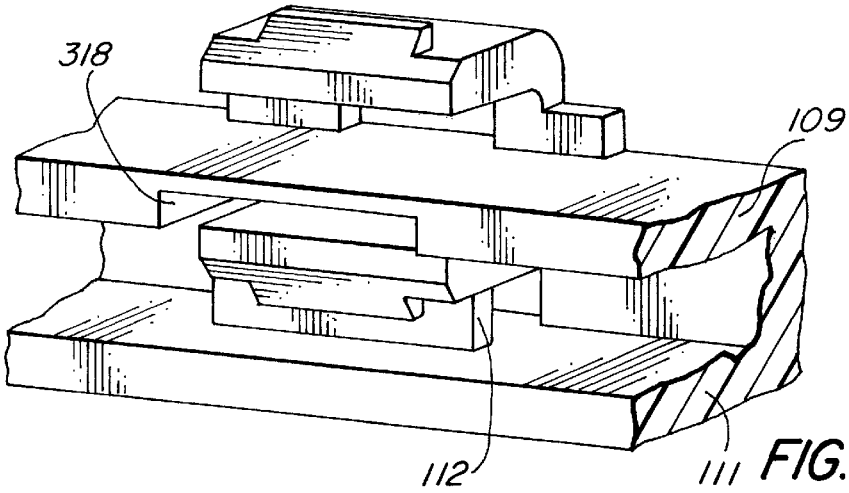
FIG. 10
FIG. 12
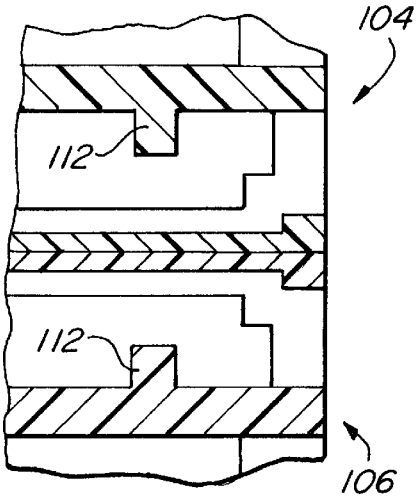
FIG. 11
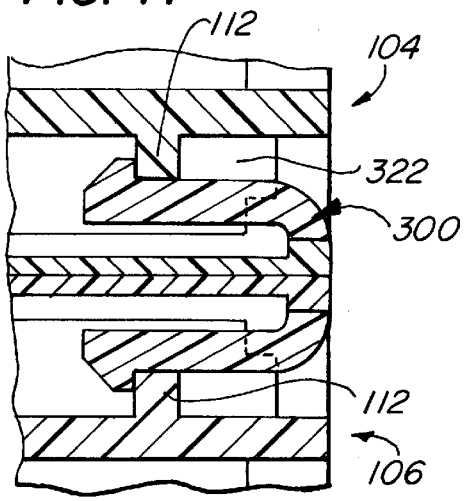

110 WIRING BLOCK INTERLOCK AND INTERLOCKED BLOCKS UTILIZING SUCH

TECHNICAL FIELD

The invention relates to 110-type wiring blocks and a means for interconnecting a plurality of such blocks to enable a manufacturer to produce a single size (e.g., 100 connector terminals) and yet meet all needs. The invention achieves this with simplicity of manufacture, assembly and system maintenance.

Communications technology (including data, audio, video and voice processing and transmission) is placing increasing demands on wire management systems and the personnel responsible for their installation and maintenance. The design of all system components must be done with attention to system integrity and ease of performance of associated manual tasks.

The Electronic Industries Association (EIA) has provided a number of standards for the purpose of defining a generic telecommunications wiring system for commercial buildings that support a multi-product, multi-vendor environment. ANSI/EIA-568-A recommends the topology and distances acceptable for cabling, which determines performance and the requirements for workstation outlets. Among the various requirements, is a specification that connecting hardware used to terminate unshielded twisted pair cables be of an insulation displacement contact (IDC) type. Connectors of the 110-type are well suited to this role, and are available in 110 cross-connect systems produced by a variety of manufacturers. Systems of this type typically include 110 wiring blocks that receive incoming cables and index them for receipt of and connection to 110C connecting blocks. Unfortunately, standardization has had the effect of providing wiring blocks in only a few sizes—typically, 100 and 300 pair sizes. These are available as separate units, and one wanting a larger or intermediate size is forced to buy something other than what is needed.

There is a current need in the art for a system that permits conveniently linking several smaller wiring block units to provide a wide variety in sizes for such blocks.

BACKGROUND ART

In U.S. Pat. No. 3,611,264, B. C. Ellis shows a 110 wiring block and a mating connector block. The wiring block is referred to therein as an indexing strip and has slots that hold the wires in the proper orientation for piercing contact to be made by IDC teeth on the wiring block.

As available today, 110 wiring blocks typically have horizontal indexing strips that accommodate 25 pairs each. Thus, a 100 pair block has a total of four such strips arranged in parallel on a single block. This can be seen by reference to the connector block shown as 100 in FIG. 1. It will be noted that the block 100 shown is identical with those available in the prior art except for the provision made for interconnecting several blocks into a single, larger block. The block 100 can be made as shown for mounting on backboard member 200 having space 220 behind the panel as shown or can have legs (not shown) that provide space behind the panel when mounted on a flat surface.

The art is awaiting the development of a 110 wiring block system that enables the provision of a wide variety of pair capacities from a single unit size.

DISCLOSURE OF INVENTION

It is an object of the invention to provide an improved 110-type wiring block.

It is another object of the invention to reduce or eliminate the need to either provide a large number of wiring block sizes or carry only a limited number of sizes and thereby force the customer to choose a size either too large or too small.

It is another object of the invention to enable the provision of a wide variety of pair capacities from a single unit size.

It is another object of the invention to provide a locking device for interconnecting a plurality of 110-type connector system wiring blocks.

These and other objects are achieved by the present invention, which provides a locking device for interconnecting a plurality of 110-type connector wiring block modules, the modules, and a modularized 110 wiring block.

The locking device of the invention comprises: a U-shaped body including a face end portion that joins two legs, each leg having a leading end including a locking tab, a joined end connected to said face end portion, and an outer leg surface. The locking device preferably has a keyway opening through the face end portion and can also have alignment tabs. The keyway and alignment tabs can be provided, either separately or together, to assure precise alignment at the time of assembly and during service.

The 110 wiring block module comprises: a wire-indexing face including at least one wire-indexing strip to accommodate a plurality of wire pairs, a frame having parallel rails positioned on two opposite sides of said wire-indexing face, wherein each wire indexing strip is parallel to and between said rails, and each of said rails has a forward face including at least two openings adapted to receive and lock therein one leg of a U-shaped locking device.

The modular 110 wiring block comprises: at least two 110 wiring block modules which include a wire-indexing face including at least one wire-indexing strip to accommodate a plurality of wire pairs, a frame having two parallel rails positioned on opposite sides of said wire-indexing face, wherein each wire indexing strip is parallel to and between said rails, and each of said rails has a forward face including at least two openings adapted to receive and lock therein one leg of a U-shaped locking device, each locking device including a face end portion (preferably having a keyway opening therethrough and/or alignment tabs extending therefrom) and joining two legs, each leg having a leading end including a locking tab, a joined end connected to said face end portion, and an outer leg surface.

BRIEF DESCRIPTION OF THE DRAWINGS

The invention will be better understood and its advantages will become more apparent from the following detailed description, especially when read in light of the accompanying drawings, wherein:

FIG. 9 is a rear perspective view showing the detail of a portion of a 110 wiring block shown in FIG. 1;

FIG. 10 is a rear perspective view showing the detail of a locking device in place on one rail of a 110 wiring block;

FIG. 11 is a cross section taken along line 11—11 in FIG. 3; and FIG. 12 is a view from the perspective of FIG. 11, with the locking device removed.

DETAILED DESCRIPTION OF A PREFERRED EMBODIMENT

Figure 1:
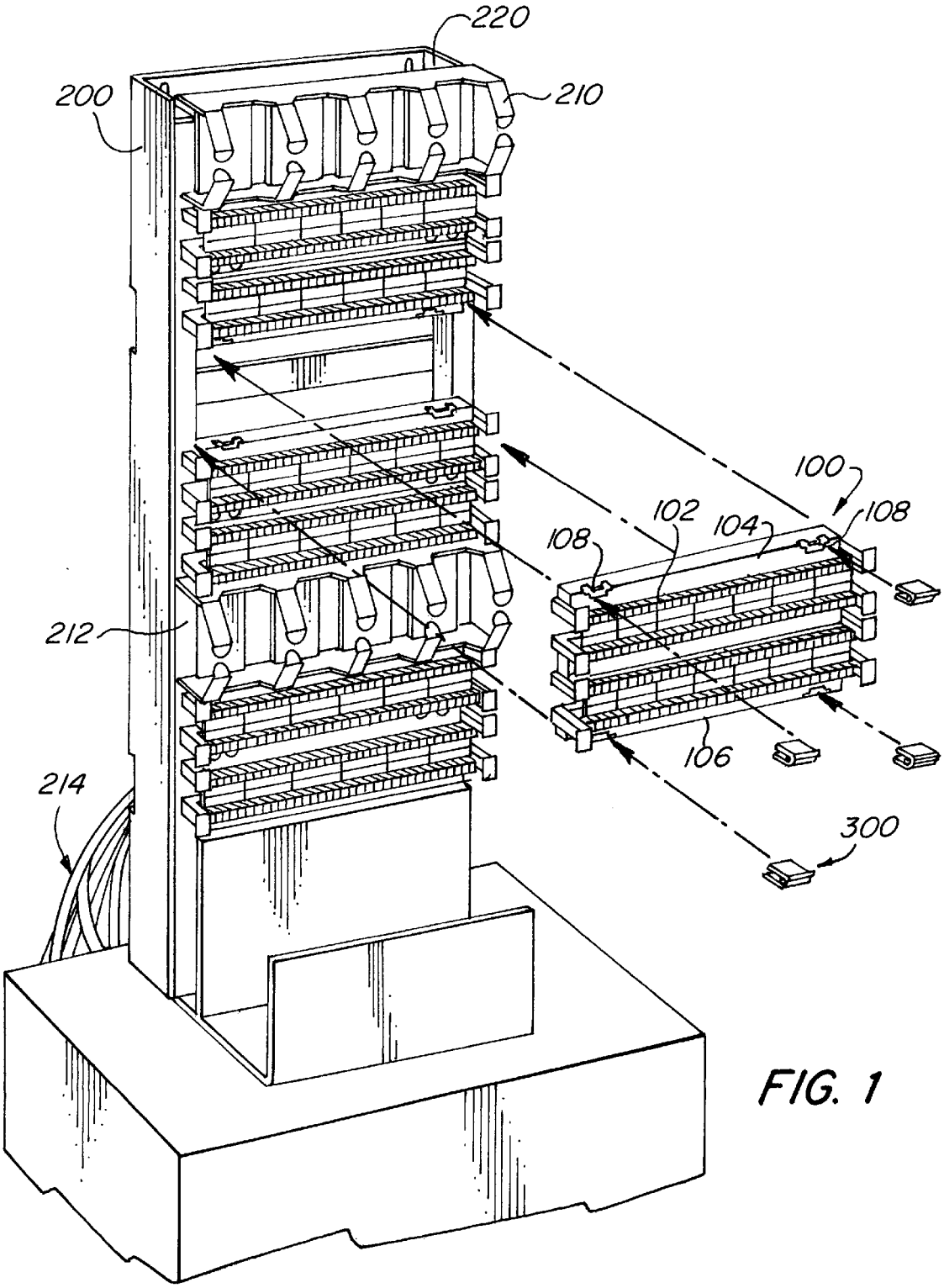
FIG. 1 is a perspective, exploded view showing the use of a 110 wiring block interlock of the invention to interlock three 110 wiring block modules on a backboard with associated wiring troughs.

Reference is made to FIG. 1, which shows in perspective an exploded view of a modular 110 wiring block of the invention. The invention provides for interconnecting at least two 110 wiring block modules 100. In FIG. 1, three 110 wiring blocks are mounted on support 200, interconnected by the use of U-shaped clips 300. The assembly is strong and resistant to displacement during wiring and extended periods of use. If desired, the wiring blocks can be provided with integral legs (not shown) for providing space for wires behind the blocks when they are secured to a planar surface.

Each of the 110 wiring block modules 100 is shown to include a wire-indexing face (the front face, unnumbered in the Figure) including at least one wire-indexing strip 102 to accommodate a plurality of wire pairs. Typically, each strip 102 will accommodate 25 wire pairs, but there is no criticality to this number. The connectors are of the IDC type. The strip or strips are framed on at least two sides by a pair of parallel rails 104 and 106 positioned on opposite edges of the wire-indexing face, top and bottom in the Figure. Each wire-indexing strip 102 is shown parallel to and between the rails, and each of the rails has a forward face including at least two openings 108 adapted to receive and lock therein one leg of a U-shaped locking device 300.

The wiring block modules 100 are shown in FIG. 1 to be assembled onto a metal backboard 200. The assembly also includes wiring troughs 210 and 212 that help organize outgoing cables (not shown). Incoming cables 214, e.g., from an outside source such as a telephone company, are shown being fed through the back of the backboard 200 and then through the interior space 220.

Each locking device 300 has a generally U-shaped configuration as shown in the drawings. As can be seen better from FIG. 2, locking device 300 has face end portion 302. The face end portion 302 is shown to have a keyway opening 304 therethrough to provide positive alignment as will be described in more detail below. The face end portion 302 joins two legs 306. Each leg has a leading end 310 including a locking tab 312. The legs are joined to the face end portion 302 at an edge. The edge where a leg and the face end portion are joined is shown to be rounded (and is unnumbered), but can be squared, chamfered or of other configuration. Each leg has an outer leg surface 314. Preferably, the locking tab 312 is formed on the outer leg surface. The locking tab is shown to have a beveled leading edge 308 and a straight trailing edge 315 to permit easy insertion but providing secure locking.

In the preferred form of the invention, the legs are formed integrally with said face end portion, such as by injection molding of a suitable thermoplastic material such as ABS. The thickness of the legs and the material will be selected to provide the proper resilience, preferably such as permits pressing into place by hand and removal with a suitable tool such as a screwdriver.

The outer leg surfaces 314 of the two legs 306 are preferably parallel, as shown. The legs will be of a shape suitable for secure locking. In the preferred form, the legs are rectangular. This shape, as will be explained in more detail below, aids in assembly. The face end portion 302 is shown to include two long sides (l), each joined to one of said legs 306 or 308, and two short sides (s), each having an alignment tab 316 extending therefrom. The relative dimensions of these sides are important in the design as shown, but can be changed with other design modifications.

Figure 2:
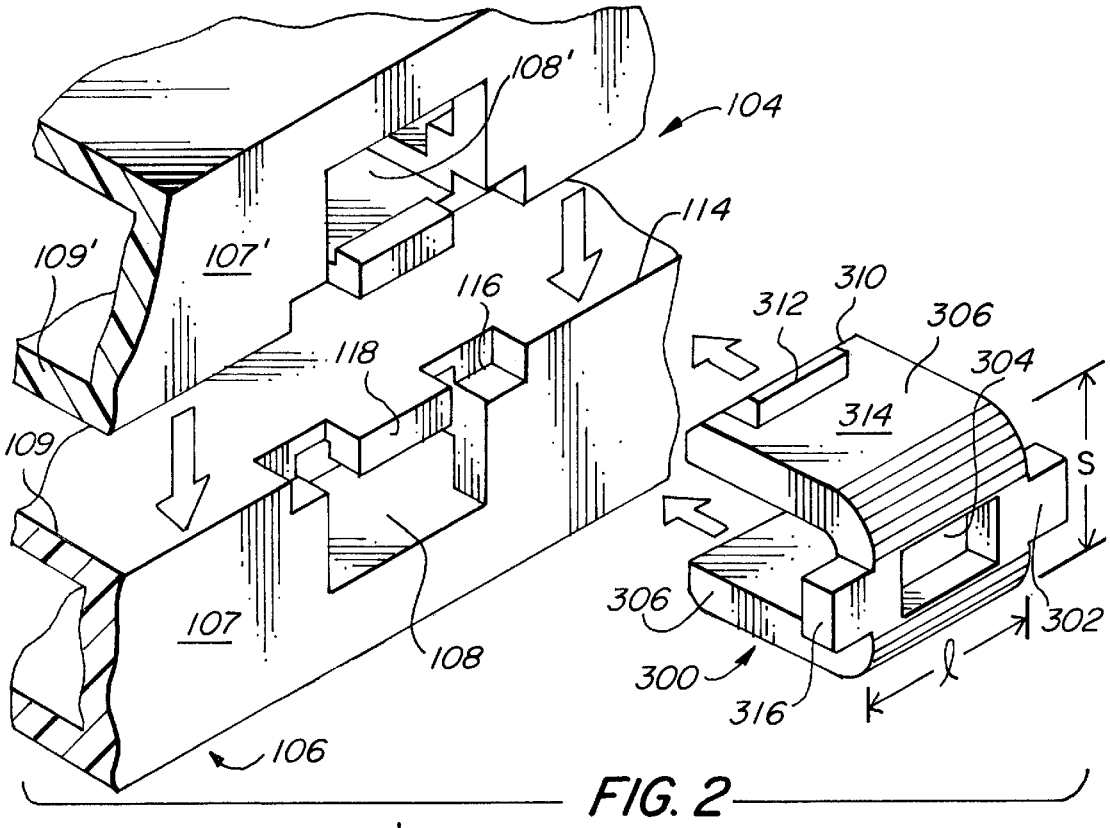
FIG. 2 is an enlarged perspective view, partially broken away, showing the detail of an interlock.
Figure 3:
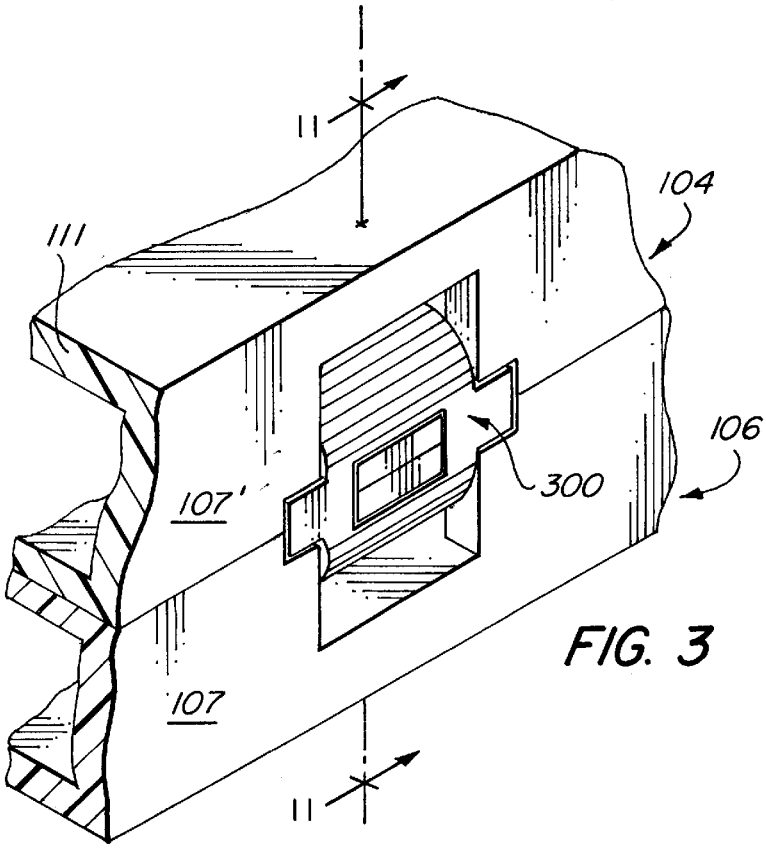
FIG. 3 is a view, from the perspective of FIG. 2, showing the detail of interlocked 110 wiring blocks.
Figure 5:
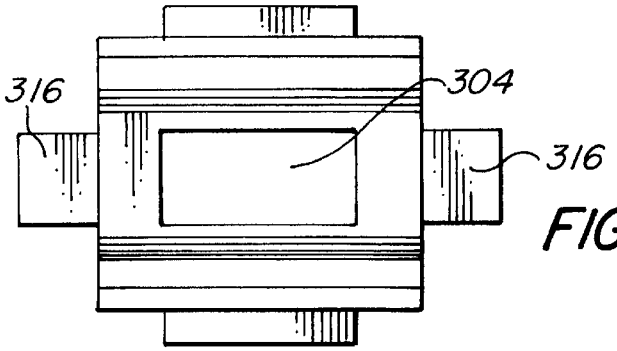
FIG. 5 is a rear elevation of an interlock device of the invention.
Figure 6:
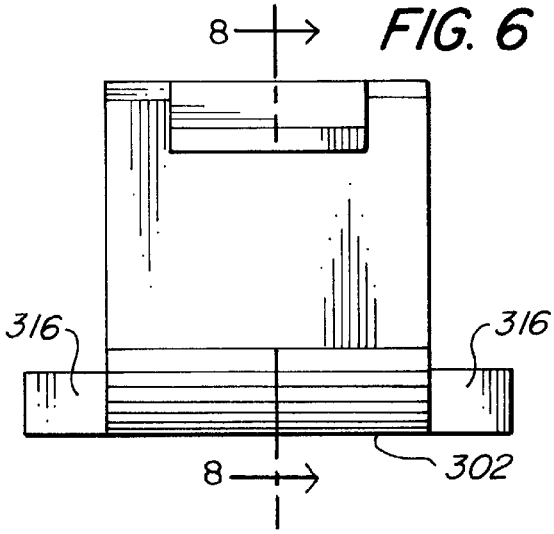
FIG. 6 is a top plan view of the device shown in FIG. 4.
Figure 7:
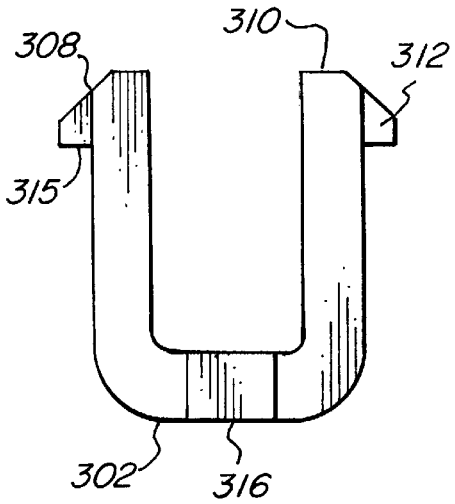
FIG. 7 is a side view of the device shown in FIG. 4, but placed face down.
Figure 4:
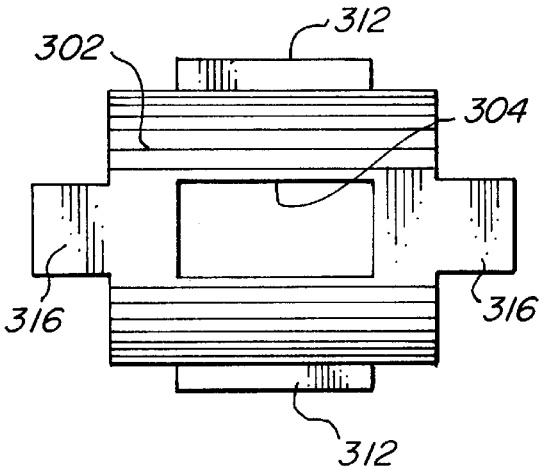
FIG. 4 is a front elevation of an interlock device of the invention.
Figure 8:
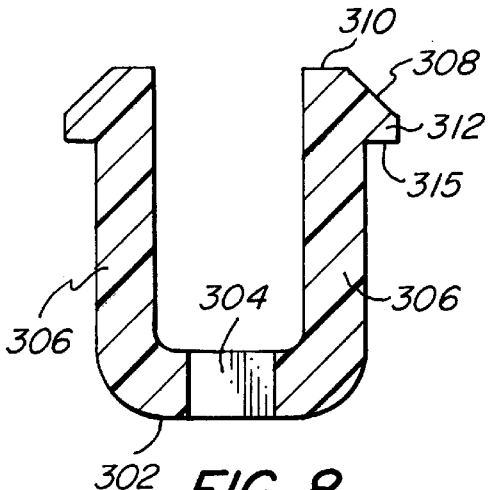
FIG. 8 is a cross-section taken along line 8—8 in FIG. 6.

Reference is made to FIGS. 2 and 3 which better show the interconnection of two modular 110 wiring blocks by the insertion of a locking device 300 into openings 108 and 108' of two adjacent rails of the two wiring blocks. Each wire indexing strip 102 (refer back to FIG. 1) is parallel to and between the rails 104 and 106. Each of the rails 104 and 106 has a forward face 107, 107', and includes at least two openings, e.g., 108, 108', adapted to receive and lock therein one leg 306 of a U-shaped locking device.

Each of the rails 104, etc., includes a face wall 107, etc., through which the openings 108, etc., extend, an outer wall, e.g., 109, 109', and an inner wall, e.g., 111, 111', parallel to the outer wall. Locking tabs 112 are affixed to the inner walls behind each of the openings 108 in the associated face wall. The outer walls and the face walls of each rail meet at an edge, e.g., 114 in FIG. 2, and include a recess at said edge on opposite sides of each of said openings. At each edge, recesses 116 are provided to provide a key 118 extending as part of each outer wall 109 toward the edge 114 from between recesses 116 at each opening, e.g., 108.

In the preferred form of assembly, locking device 300 is inserted into openings of two adjacent rail faces, guided by a channel shown cut or molded into the interior surface of the outer wall (e.g., see 318 in FIG. 9). Keys 118 fitting into keyway 304 in the locking device 300 then provide positive alignment. Alignment tabs 316 can be provided for better stability by fitting into recesses 116. Typically, assembly is made by inserting the tab with finger pressure. Disassembly can be achieved by inserting the blade of a screwdriver into the space (e.g., 122 in FIG. 11) between a leg 306 and the associated inside wall 111.

The above description is for the purpose of teaching the person of ordinary skill in the art how to practice the present invention, and it is not intended to detail all of those obvious modifications and variations of it which will become apparent to the skilled worker upon reading this description. It is intended, however, that all such obvious modifications and variations be included within the scope of the present invention which is defined by the following claims. The claims cover the indicated components and steps in all arrangements and sequences which are effective to meet the objectives intended for the invention, unless the context specifically indicates the contrary.

We claim:

1. A 110 wiring block module comprising:

(a) a wire-indexing face including at least one wire-indexing strip to accommodate a plurality of wire pairs, (b) a frame having two parallel rails positioned on opposite sides of said wire-indexing face, wherein each wire indexing strip is parallel to and between said rails, and each of said rails have a face wall with at least two openings spaced along the length thereof, and an inner wall substantially perpendicular to said face wall with locking tabs thereon aligned with said openings engageable with one leg of a U-shaped locking device inserted through said openings to lock therein the one leg of the U-shaped locking device.

2. A 110 wiring block module according to claim 1 wherein:

each of said rails additionally includes an outer wall parallel to said inner wall.

3. A 110 wiring block module according to claim 2, wherein:

said outer wall and said face wall of each rail meet at an edge and include a recess at said edge on opposite sides of each of said openings.

4. A 110 wiring block module according to claim 3, wherein:

said recesses at said edge are configured to provide a key extending as part of said outer wall toward said edge from between said recesses at each opening.

5. A 110 wiring block module according to claim 3, wherein:

at each opening, said outer wall is recessed to form a channel in an inner surface of said outer wall.

6. A 110 wiring block module according to claim 3, wherein:

said outer wall and said face wall of each rail meet at an edge and include a recess at said edge on opposite sides of each of said openings;

said recesses at said edge are configured to provide a key extending as part of said outer wall toward said edge from between said recesses at each opening; and at each opening, said outer wall is recessed to form a channel in an inner surface of said outer wall.

7. A modular 110 wiring block assembly, comprising:

(a) at least two 110 wiring block modules in overlying relationship which include (i) a wire-indexing face including at least one wire-indexing strip to accommodate a plurality of wire pairs, (ii) a frame having two parallel rails positioned on opposite sides of said wire-indexing face, each wire indexing strip being parallel to and between said rails, each of said rails having a face wall including at least two openings spaced along the length thereof, and an inner wall substantially perpendicular to said face wall with formations thereon aligned with said openings adapted to receive and lock therein one leg of a U-shaped locking device, said openings in said face walls of said overlying modules being aligned; and (b) locking devices of generally U-shaped configuration seated in said aligned openings of said modules, said locking devices including a face end joining two legs, each leg having a leading end including a locking formation engaged with said formation on said inner wall a joined end connected to said face end portion and an outer leg surface.

8. A modular 110 wiring block assembly according to claim 7, wherein:

said legs are formed integrally with said face end, said face end having a keyway opening therethrough.

9. A modular 110 wiring block assembly according to claim 7, wherein:

the outer leg surfaces of the two legs are parallel.

10. A modular 110 wiring block assembly according to claim 7, wherein:

said face end portion includes two long sides, each joined to one of said legs, and two short sides, each having an alignment tab extending therefrom.

11. A modular 110 wiring block assembly according to claim 7 wherein:

each of said rails additionally includes an outer wall parallel to said inner wall, and wherein said formations are locking tabs on said inner walls.

12. A modular 110 wiring block assembly according to claim 11, wherein:

said outer wall and said face wall of each rail meet at an edge and include a recess at said edge on opposite sides of each of said openings.

13. A modular 110 wiring block assembly according to claim 12, wherein:

said recesses at said edge are configured to provide a key extending as part of said outer wall toward said edge from between said recesses at each opening.

* * * * *